United States Patent [19]

Shillington

[11] 4,043,562

[45] Aug. 23, 1977

[54] PUTTER ALIGNMENT SIGHT

[76] Inventor: Brian G. Shillington, 601 E. Anatamu Ave., Santa Barbara, Calif. 93101

[21] Appl. No.: 669,024

[22] Filed: Mar. 22, 1976

Related U.S. Application Data

[63] Continuation-in-part of Ser. No. 539,793, Jan. 9, 1975, abandoned.

[51] Int. Cl.[2] ..... A63B 53/04

[52] U.S. Cl. ..... 273/164

[58] Field of Search ..... 273/77 R, 78, 164, 167 D, 273/183 D; D34/5 GH, 5 GC

[56] References Cited

U.S. PATENT DOCUMENTS

| | | | |
|---|---|---|---|
| 1,046,343 | 12/1912 | Smith | 273/164 |
| 2,842,369 | 7/1958 | East | 273/164 |
| 3,486,755 | 12/1969 | Hodge | 273/164 |
| 3,549,300 | 12/1970 | Pelz | 273/164 X |
| 3,876,211 | 4/1975 | Caligiuri | 273/164 X |
| 3,880,430 | 4/1975 | McCabe | 273/164 X |
| D. 179,246 | 11/1956 | Gillon | 273/164 X |
| D. 207,227 | 3/1967 | Solheim | 273/167 D X |
| D. 211,100 | 5/1968 | Baker | 273/164 X |
| D. 212,890 | 12/1968 | Rose | 273/167 D X |
| D. 221,446 | 8/1971 | Cook | D34/5 GH |
| D. 232,252 | 7/1974 | Cook | 273/78 X |
| D. 232,316 | 8/1974 | Cook | D34/5 GH |
| D. 234,206 | 1/1975 | Cook | D34/5 GH |
| RE. 19,178 | 5/1934 | Spiker | 273/164 |

OTHER PUBLICATIONS

"Golf World"; Apr. 13, 1973; p. 42.
"Golf Digest"; Apr. 1974; p. 122.

*Primary Examiner*—Richard J. Apley
*Attorney, Agent, or Firm*—Lyon & Lyon

[57] ABSTRACT

A golf putter having a forward wall forming a putting face, a portion of reduced thickness behind the wall, a slot in the rear portion of the wall perpendicular to the putting surface, a cavity having a portion underlying the slot, and an exposed portion rearwardly of the wall occupying a major portion of the vertical dimension of the putter and having a marker line spaced downwardly from the upper surface of the slot and visible through the slot to form an alignment sight.

5 Claims, 7 Drawing Figures

PUTTER ALIGNMENT SIGHT

This application is a continuation-in-part of application Ser. No. 539,793, filed Jan. 9, 1975, now abandoned.

SUMMARY

The present invention is directed to a golf putter with an alignment sight and is summarized in the following objects:

First, to provide a putter with an alignment sight which aids a golfer in assuming a proper stance including head alignment as well as to aid in positioning the putter face and putter shaft.

Second, to provide a putter as indicated in the preceeding object wherein the upper surface of the putter is provided with a transverse slot, an underlying cavity forming a flat upper surface and having a transverse readily visible marker line spaced downwardly from the top surface of the putter and visible through the slot whereby when sighted through the slot, has apparent movement when the players' head is moved, thus forming with the slot an alignment sight.

Third, to provide a putter as indicated in the previous objects wherein the marker slot is traversed by a reference line on the depressed top surface of the cavity for vertical alignment with the transverse slot.

Fourth, to provide a putter as indicated in the previous objects wherein the slot and marker line is observable by peripheral vision during swinging of the putter while the player focuses his sight on the golf ball.

Fifth, to provide a putter with an alignment sight as indicated in the other objects, wherein the sight or marker line may be formed by a slit penetrating the bottom side of the putter, or a readily visible colored marking.

DETAILED DESCRIPTION

Figure 1:
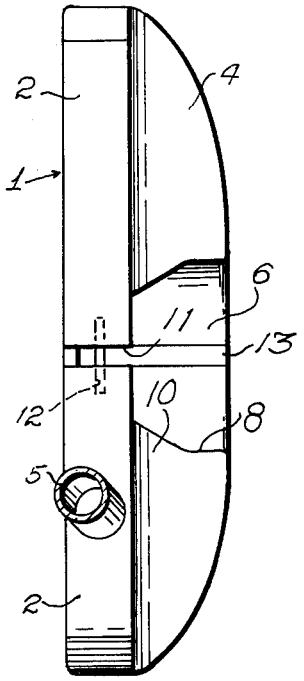
FIG. 1 is a top view of a golf putter with shaft in section taken through 1—1 of FIG. 2, the golf putter being shown in essentially the position as viewed when in use.
Figure 3:
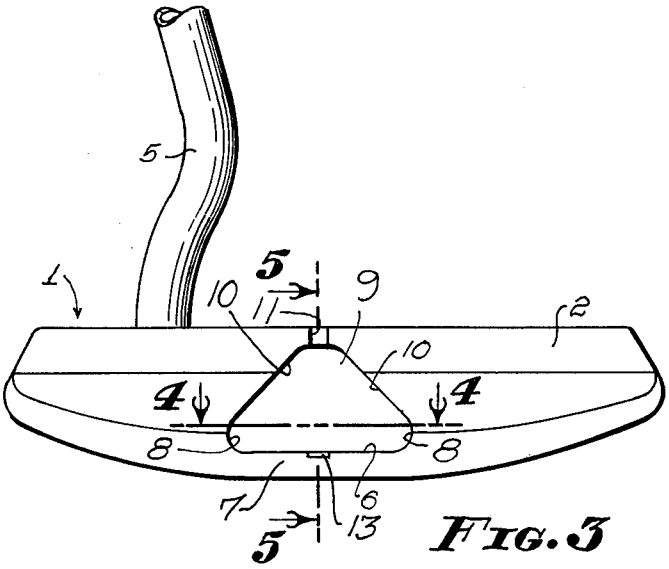
FIG. 3 is a rear view thereof with the shaft shown fragmentarily.
Figure 4:
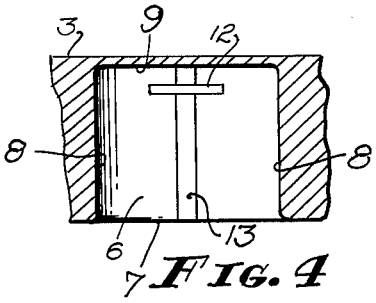
FIG. 4 is a fragmentary sectional view taken through 4—4 of FIG. 3.
Figure 2:
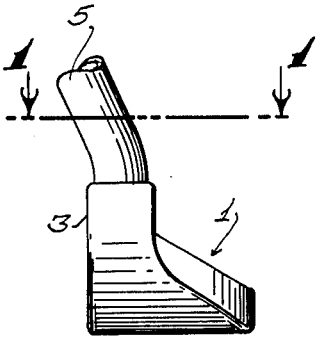
FIG. 2 is an end view of the golf putter with the shaft shown fragmentarily.
Figure 5:
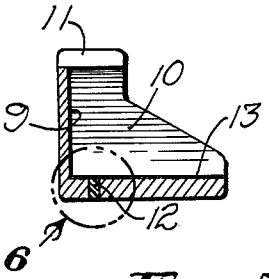
FIG. 5 is a transverse sectional view taken through 5—5 of FIG. 3.
Figure 6:
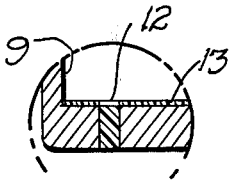
FIG. 6 is an enlarged fragmentary sectional view taken within Circle 6 and FIG. 5 showing the alignment sight filled with a highly visible plastic material.

The golf putter includes a putting head 1 having a forward wall 2, the upper portion of which is of uniform width and one side forms a putting surface 3. The rear portion of the putting head is reduced in thickness as indicated by 4. One end of the forward wall receives a conventional putter shaft 5.

Formed in the putting head is a centrally located cavity 6 occupying a substantial portion of the depth of the putting head, the under side of which forms a relatively thin bottom wall or flange 7 having an upwardly exposed surface rearwardly of the wall 2 having lateral boundaries 8. The cavity 6 extends forwardly into the wall 2 to form a forward vertical surface 9, and an upper flange 10 having a central portion close to the upper surface of the wall 2, lateral wall portions downwardly diverging to the lateral boundaries 8.

Formed in the wall 2 is a narrow transverse slot 11 which is centered with respect to the cavity 6 exposing the central portion of the forward vertical surface 9. The slot 11 defines with the exposed portion of the surface 9, a reference edge spaced a substantial distance above that portion of the upper surface of the flange 7 underlying upper flange 10.

The portion of the lower flange 7 underlying the upper flange 10 is provided with a sighting line 12 in the form of a narrow slit extending through the flange 7 parallel to the vertical surface 9 and spaced rearwardly therefrom. The sighting line 12 is visible through the slot 11 and its length is greater than the width of the slot.

Also the upper surface of the bottom flange 7 may be provided with a second sighting line 13 perpendicular to the sighting line 12 and in the same vertical plane as the slot 11. Either or both sighting lines may be filled with a plastic material to increase visibility and provide a contrast.

The golf putter is used as follows:

If the Golfer stands with his head over the putter the sighting line 12 will appear to extend crosswise to the slot 11 intermediate the forward and rearward ends of the slot and rearwardly of the reference edge by the surface 9 exposed through the slot 11. Due to the fact that the sighting line 12 is of greater length then the width of the slot 11, the sighting line 12 remains in full view even though the Golfer may move his head a short distance parallel to the sighting line. If the Golfer moves his head forwardly or rearwardly; that is, transverse to the putting face 3, the sighting line will appear to be displaced forwardly or rearwardly with respect to the slot 11 and the reference edge. Such movement can be readily detected, by the Golfer, thus aiding him to maintain his line of sight fixed. Also, should the Golfer move his head parallel to the putting face 3, the slot 11 and reference edge will appear to move relatively.

It is essential in order to develop a good putting technique, that one be able to repeat his position when addressing the ball. By reason of the fact that forward or rearward movement as well as lateral movement of the line of sight and the amount thereof can be readily detected by the apparent displacement of the sighting lines 12 and 13, increased accuracy is obtained.

It has been noted that while the golfer's eyes remain focused on the ball, as the putter is brought back prior to striking the ball that, during both such backward movement and forward movement or lateral movement in the course of stroking the ball, peripheral vision will detect the movement of the slot 11 and the sighting lines 12 and 13 aiding detection of any deviation which can be corrected before the ball is struck. In addition, it programs the golfer to mentally respond by keeping the putter properly aligned during the stroke, thus returning the putter to its original position when striking the ball.

Figure 7:
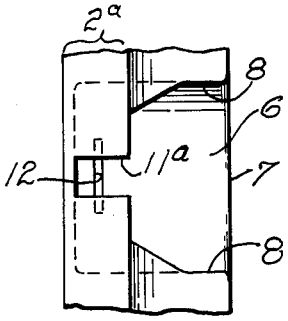
FIG. 7 is a fragmentary plan view showing a modification of the golf putter wherein the slot is increased in size.

Reference is made to FIG. 7 wherein the forward wall is increased in width as indicated by **2*a*, and the slot is also increased in width as indicated by 11*a*. Also the slot may terminate short of the putter face to coincide with the forward surface 9 so that the reference edge is flush with the upper surface of the forward wall 2a**. The purpose is to increase visibility. Operation is as previously described.

It should be noted that the essential features of this invention concern the slot 11 or 11*a*, the reference edge formed by the exposed edge of the surface 9 and the sighting lines 12 and 13 spaced downwardly from the upper surface of the putter so as to undergo apparent displacement upon head movement. Also, the transverse sighting line 13 helps the Golfer to maintain the putting face perpendicular to the line of travel. Consequently, as long as these features are maintained, the general contour of the putter may be varied.

Having fully described my invention it is to be understood that I am not to be limited to the details herein set forth, but that my invention is of the full scope of the appended claims.

I claim:

1. A golf ball putter comprising:

a. a putter blade having a forward putting face, a rear face and upper and lower faces;

b. a recess in said blade extending forwardly from said rear face, said recess having upper and lower surfaces adjacent to but spaced from said upper and lower faces, to define rearwardly extending upper and lower flanges respectively, and a forward surface parallel to said putting face;

c. a slot through said upper flange extending rearwardly from at least said forward surface of said recess perpendicular to said putting face and communicating with said recess and being of a depth no greater than said upper flange and defining a reference edge at its juncture with said forward surface, said reference edge being spaced upwardly from said lower surface substantially the full height of said recess; and d. a reference line on said lower surfsce extending parallel to said putting face and being below said slot to be visible therethrough and spaced rearwardly from said forward surface of said recess a sufficient distance such that said reference line remains in full view and undergoes apparent forward-rearward displacement with respect to said slot and reference edge as the golfer moves his head, respectively, forwardly or rearwardly.

2. A golf ball putter as defined in claim 1, wherein:

a. said slot extends forwardly to and through the upper edge portion of said putting face.

3. A golf ball putter as defined in claim 1, wherein:

a. said slot terminates short of the putter face.

4. A golf ball putter as defined in claim 1, wherein:

a. said upper flange extends rearwardly from said forward surface a distance greater than the distance from said reference line to said forward surface.

5. A golf ball putter as defined in claim 1, wherein:

a. the lower flange of the recess includes a transverse reference line perpendicular to the putting face in vertical alignment with the slot in the upper flange of the recess.

* * * * *